United States Patent [19]

Yuan

[11] Patent Number: 4,712,456

[45] Date of Patent: Dec. 15, 1987

[54] ELECTRIC TORSION-CONTROLLED SCREWDRIVER WITH AN IMPROVED AUTOMATIC TURN-OFF DEVICE

[75] Inventor: Lo J. Yuan, Yung Ho City, Taiwan

[73] Assignee: Top Driver Enterprise Co., Ltd., Taipei Hsien, Taiwan

[21] Appl. No.: 881,364

[22] Filed: Jul. 2, 1986

[51] Int. Cl.[4] ..... B25B 23/157

[52] U.S. Cl. ..... 81/473; 81/478; 173/12; 173/93.5

[58] Field of Search ..... 81/473, 467, 469, 474, 81/478, 479, 475, 480; 173/12, 93, 93.5, 93.7

[56] References Cited

U.S. PATENT DOCUMENTS 4,231,270 11/1980 Totsu ..... 81/474

4,458,565 7/1984 Zilly et al. ..... 81/469

4,631,992 12/1986 Eckman ..... 81/469 X

*Primary Examiner*—Frederick R. Schmidt

*Assistant Examiner*—Maurina Rachuba

*Attorney, Agent, or Firm*—Sughrue, Mion, Zinn, Macpeak and Seas

[57] ABSTRACT

An electric screwdriver with an improved automatic turn-off device has a novel clutch mechanism with a upper clutch member and a lower clutch member, a switch device for controlling the driving means according to the tightness of a screw or nut on a workpiece and a switch device supporting means with a force absorbing spring, wherein said upper clutch member has two bottom substantial triangular cam protrusions, each of which has two arcs with different curvature and the lower clutch member has a flange portion with two holes and ball members whereby they are arranged and assembled in a simple mechanism for the user to use conveniently and effectively.

14 Claims, 29 Drawing Figures

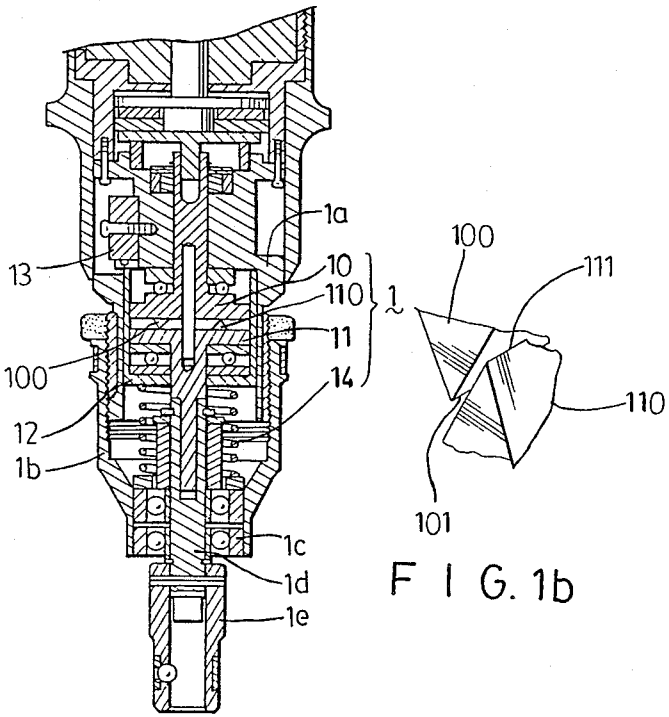
FIG. 1a
PRIOR ART
FIG. 1b
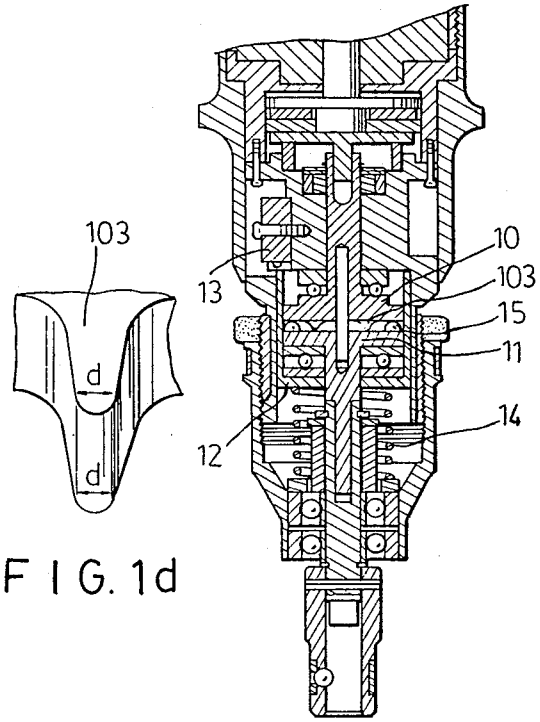
FIG. 1C
PRIOR ART
FIG. 1d

F I G.10a A-A

ELECTRIC TORSION-CONTROLLED SCREWDRIVER WITH AN IMPROVED AUTOMATIC TURN-OFF DEVICE

BACKGROUND OF THE INVENTION

The present invention relates to an electric screw driver with an improved automatic turn-off device, particularly concerning an improved electric torsion-controlled screw driver with an improvement on the clutch mechanism and an automatic turn-off switch device which can control the electric screw driver effectively and conveniently.

FIG. 1*a* is a partial side sectional view of a prior electric screw driver showing a clutch mechanism 1 for driving the screw driver and a switch device 13. As the arrangement of a driving means for driving the screw driver, a handle switch for switching on said electric screw driver and a reducing gear assembly for transmitting rotating power to the clutch mechanism are conventional arrangements, they are not described in detail for the prior electric screw driver.

The clutch mechanism 1 includes a clutch housing 1*a*, an upper clutch member 10 which connects with the driving means through the reducing gear assembly and which is received in the clutch housing 1*a*, and a lower clutch member 11 received in the clutch housing 1*a* and connected the upper clutch member 10 by a rod member. The upper clutch member 10 further has a first triangular cam protrusion 100 at its bottom end and the lower clutch member 11 further includes a second triangular cam protrusion 110 at its upper end. A switch device 13 is provided at the head portion of the clutch housing and a supporting bowl 12 is received in the clutch housing 1*a* so that the upper edge of the supporting bowl 12 is engaged with the switch device 13. The supporting bowl 12 has a bottom opening so that a lower extending portion of the lower clutch member 11 passes through it and the upper portion of the lower clutch member is disposed against the bottom end of the supporting bowl 12.

A cylindrical cover member 1*b* with a bottom opening and an inner threaded surface is threaded on the outer threaded surface of the clutch housing 1*a* for covering the lower extending portion of the lower clutch member 11, wherein an inner flange portion is provided at the bottom opening of the cylindrical cover 1*b*. A retaining means 1*c* is provided at the bottom opening of the cylindrical cover member 1*b* and an elongated retaining rod member 1*d* which connects with the lower extending portion of the lower clutch member 11 is passed through the bottom opening and retained firmly by the retaining means 1*c*. A socket member 1*e* is connected with the outer end of the elongated rod member 1*d* for receiving a screw driver. (not shown in FIG. 1)

A torsion spring member 14 received in the cylindrical cover member 1*b* and sleeved on the lower clutch member, is disposed on the inner flange portion of the cylindrical cover member 1*b* for supporting and biasing the supporting bowl 12, whereby, the electric screw driver can tighten or loosen a screw of a workpiece if the electric screw driver is switched on through the handle switch as the driving means drives the clutch mechanism 1, the first triangular cam protrusion 100 of the upper clutch member 10 may engage with the second triangular cam protrusion 110 of the lower clutch member 11 (see FIG. 1*b*) and move the lower clutch member 11 down slightly when the lower clutch member 11 stops rotation if the screw is tightened tightly, so that the supporting bowl 12 is moved down and disengaged from the switch device 13, wherein the driving means stops as the switch device 13 is actuated by disengaging the supporting bowl 12 from it, even the handle switch is turned on. Then, after releasing the handle switch, the upper and lower clutch member 10, 11 return to their initial position due to the torsion of the torsion spring member 14.

The above-mentioned electric screw driver has the following drawbacks:

(1) The edge 101 of the first triangular cam protrusion 100 and the edge 111 of the second triangular cam protrusion 110 are easily damaged because they abrade each other each time the first cam protrusion 100 engages with and pushes down the second cam protrusion 110. This may decrease the precision of the torsion and cause unbalanced torsion.

(2) Generally, the initial driving force for unfastening a tightened screw is greater than the initial driving force for tightening a loosened screw. Although the switch device 13 and the clutch mechanism 1 to stop the driving means used in the prior electric screw driver are convenient in the screw-tightening operation, the switch device 13 may cause trouble in the screw-unfastening operation since a large initial driving force is necessary for unfastening a tightened screw. If the screw is tightened tightly, the lower clutch member 11 cannot rotate suddenly for the unfastening operation, when the upper clutch member 10 is driven by the driving means and is rotating so that the first cam protrusion 100 may engage and push down the second cam protrusion 110 of the lower clutch member 11. This may cause the switch device to turn off the driving means automatically. In this condition, the tightened screw cannot be unfastened by the electric screw driver easily, which is inconvenient for the user.

(3) The socket member 1*e* adapted to receive the screw driver is provided outside the cylindrical cover member 1*b* so that the screw driver portion extends far out and is difficult to control when handling the electric screwdriver.

(4) As the supporting bowl 12 and the clutch mechanism 1 are returned back to their initial position by the torsion spring member 14, the switch device 13 is always hit strongly by the upper edge of the supporting bowl 12 so that the switch device 13 may be easily damaged.

FIG. 1*c* is another prior electric screw driver with a slight improvement on the shape of the cam protrusions of the upper and lower clutch member. In this improvement, the upper clutch member 11 has a substantially triangular cam protrusion 103 with two identical arcs with symattrical curvatures (see FIG. 1*d*) instead of the first cam protrusion 100. The lower clutch member 11 has a ball shaped protrusion 15 instead of the second cam protrusion 110.

Although the above-mentioned improvement can reduce abrasion damage to the cam protrusion 103 and ball shaped protrusion 15, the other disadvantages such as hitting of the torsion spring member, and the long extension of the socket member for receiving the screw driver are not solved. In addition, the bottom summit portion of the substantially triangular cam protrusion 103 has a width 'd' which may be damaged by frequent abrasion.

SUMMARY OF THE INVENTION

With the above problems in mind, the main object of the invention is to provide an improved electric screw driver with a novel automatic switch device which is simple in construction and convenient to use.

An object of the invention is to provide an improved electric screw driver including a switch device supporting means with a biasing spring member to absorb the rebounding of the supporting means to the switch device so that the switch device can be used for a long time with no damage.

Another object of the invention is to provide an improved electric screw driver with a upper clutch member, and a lower clutch member which can be received in the upper clutch member, and wherein the upper clutch member has a substantially triangular cam protrusion with two arc sides of different curvatures, and the lower clutch member has a hole and ball which can be pushed by the cam protrusion of the upper clutch member to push down the clutch mechanism a little for disengaging the supporting means from the switch device to stop the driving means automatically by the disengaging movement of the clutch mechanism precisely and conveniently. The cam protrusion can also be prevented from damage by abrasion.

A further object of the invention is to provide an improved electric screw driver with a socket member adapted to receive a plurality of screw drivers and nut drivers arranged in the electric screw driver housing to shorten the total length of the electric screw driver so that the user can operate the electric screw driver more conveniently and effectively on the workpiece.

In order to achieve the aforesaid objects as well as other incidental objects and advantages, the invention includes a hollow cylindrical housing, an electric circuit device with a power source, a driving means and a reducing gear mechanism which are provided in the cylindrical housing, a handle switch for turning on said driving means provided at an upper portion of the hollow cylindrical housing, and an improved automatic turn-off device comprising a clutch mechanism driven by the driving means including a clutch housing with a head portion, an inner annular flange portion provided at the bottom opening thereof and an outer threaded surface, an upper clutch member with a base flange portion and a bottom hollow portion, slidably received in the clutch housing, and a lower clutch member with an upper extending portion which is received in the bottom hollow portion of the upper clutch member; wherein: the head portion of the clutch housing further includes an upper flange portion with a screw hole for fixing the clutch housing to the hollow cylindrical housing through a screw, and the upper clutch member further has a substantially triangular-shaped cam protrusion with two arcs of different curvatures, extending from the bottom surface of the base flange portion, and the lower clutch member has an annular flange portion provided between a lower part of lower clutch member and its upper extending portion, a hole and a ball member are provided on the annular flange portion of the lower clutch member wherein the ball can be received in the hole once it is moved into the hole by the cam protrusion, a sleeve member movably sleeve on the lower clutch and a bearing ring is sleeved and retained on the sleeve member.

A switch device for short circuiting the electric circuit of the driving means and to turn off automatically the driving means adapted to connect with the power source is provided on the head portion of the clutch housing. The switch device includes two contacting plates and a movable rod member for connecting the two contacting plates which vertically extends into the clutch housing, wherein the switch device is in an arrangement that the two contacting plates are normally disconnected when the driving means is turned on, and the handle switch and the driving means are stopped from operating, even if the handle switch is turned on, if the rod member engages the two contacting plates to short circuit the driving means.

A switch device supporting means for supporting the switch device is received in the clutch housing and is provided around the upper and lower clutch members for controlling the switch device to short circuit the driving means. The switch device supporting means is a tubular sleeve which has an inwardly bent flange portion at its bottom end for retaining the bearing ring and the sleeve member of the lower clutch member, wherein the tubular supporting sleeve member includes a force absorbing spring which sleeves on the sleeve member of the clutch mechanism and the lower clutch member. The switch device supporting means is provided on the inner annular flange of the clutch housing for supporting and biasing the tubular supporting sleeve member.

A cylindrical cover member with a bottom opening and an inner threaded surface is threaded on the outer threaded surface of the clutch housing for covering the lower clutch member, wherein an inner flange portion is provided at the bottom opening of the cylindrical cover.

A torsion spring member retained in the clutch housing and the cylindrical cover member and sleeved on the lower clutch member, is disposed on the inner flange portion of the cylindrical cover member for supporting and biasing the bearing ring and the sleeve member of the lower clutch member.

A socket member adapted to receive different kinds of screw driver or box spanners, is inserted into the cylindrical cover member through the bottom opening of the cylindrical cover member and fixed to the lower clutch member.

When in use, the electric screw driver can tighten or unfasten a screw or a nut on a workpiece if the electric screw driver is switched on through the handle switch, as the driving means drives the clutch mechanism through the reducing gear assembly. The substantially triangular cam protrusion of the upper clutch member moves the ball into the hole of the lower clutch member when the clutch member is stopped rotating if the screw or nut being tightened tightly. The ball presses down the sleeve member through the hole so that the switch device supporting means is pressed down by the bearing ring and disengaged from the switch device, whereby the driving means is short circuited and stopped from working even the handle switch is turned on. After the driving means of the electric screw driver is automtically stopped by the switch device, the user releases his hand from the handle switch. Then, the clutch mechanism and the switch device supporting device return to their initial positions due to the torsion of the torsion spring.

The switch device and the switch device supporting means can be designed in another arrangement that the switch device supporting means includes a supporting ring member with a bottom inner inwardly bent flange portion and an annular supporting bowl member with an opening at its base, wherein the bearing ring and the upper annular flange portion of the lower clutch member sit on the inner surface of the base of the annular supporting bowl and the lower clutch member and sleeve member pass through the opening of the annular supporting bowl member. The supporting bowl member includes an upper outwardly bent flange portion provided at the upper end of the supporting bowl member which is engaged with the inwardly bent flange portion of the supporting ring member. The supporting bowl member further has a bottom annular flange portion provided at the base of the supporting bowl member. A force absorbing spring member disposes on the third spring member and sleeves on the supporting bowl member to support the supporting ring member, and the supporting bowl member is supported by the spring member so that the supporting ring member can disengage from the rod member of the switch device when the ball is pushed into the hole of the sleeve member by the substantially triangular cam protrusion to push down the sleeve member and bowl member and then to short circuit and to stop the driving means.

The switch device according to a further design of this invention, includes two parallel plates, each of which includes a contacting point which is connected with the electric circuit of the driving means. A biasing spring plate is provided between the two parallel plates for normally disengaging the two parallel plates a little apart. The switch device supporting means is a hollow sleeve member with an upwardly extending hook member which can hook on the upper plate of the two parallel plates, wherein the hook member can pull down the upper plate of the two parallel plate to connect the two contacting points together for short circuiting the driving means when the ball member is pushed into the hole of the sleeve member by the cam protrusions.

The switch device also can be designed in an arrangement using a microswitch and an actuating pushing plate provided under the microswitch, which is pushed upwardly by the switch device supporting means to press the microswitch, wherein the microswitch can short circuit the driving means when the pushing plate is release from the microswitch when the switch device supporting means is moved down.

The electric screw driver also can be arranged in a novel arrangement that a chamber for retaining a driving means controlling switch device is provided in the upper portion of the hollow cylindrical housing adjacent to the handle switch. The switch device in the chamber is substituted for the switch device which is provided around the head portion of the clutch housing so that the clutch mechanism and clutch housing are simpler and easier to assemble.

The switch device provided in the chamber including a first switch controlled by the handle switch for controlling input power and a second switch for controlling the operation of the driving means, and a movable plate assembly with a plurality of spring members. The movable plate assembly is in an arrangement for switching on and off the first and second switch. The movable plate assembly of the switch device includes a first plate member with an extending portion extending out of the hollow cylindrical housing, wherein the extending portion connects with the handle switch and a first switch contacting portion provided adjacent to the first switch, a second plate member arranged as a fulcrum having a base extending portion for engaging with an elongated rod member and a second switch, contacting portion for controlling the second switch and a third plate member with a safety retaining protrusion for preventing the second contacting portion of the second plate member from contacting the second switch when the driving means is in normal operation as the second switch is arranged in normally closed condition for the electric circuit of the driving means. (i.e., the second switch is in closed condition if it is not contacted by the second contacting portion of the second plate member and the second switch is in opened condition if the second contacting portion contacts to the second switch).

The bottom end of the elongated rod member is engaged with the upper outwardly bent flange portion of the tubular sleeve. The plurality of spring member includes a first pulling spring to retain the rod member and a second pulling spring connected with the second contacting portion of the second plate member and normally pulling the second contacting portion away from the second switch, wherein the electric screw driver can tighten or unfasten a screw or nut on a workpiece if the electric screw driver is switched on through the first switch of the switch device by pressing the handle switch, as the driving means drives the clutch mechanism.

The substantially trangular protrusion of the upper clutch member can move the the ball into the hole of the lower clutch member when the clutch member is stopped rotating if the screw or nut is tightened tightly, and the ball can press down the sleeve member through the hole so that the tubular sleeve is pressed down by the bearing ring and sleeve member of the lower clutch member, wherein the second switch of the switch device is activated to stop the driving means through the elongated rod member by actuating the second switch at this time even if the handle switch is turned on.

BRIEF DESCRIPTION OF THE DRAWINGS

These and other advantages, objects and features of the invention will become apparent from the following detailed description of the preferred embodiment with reference to the accompanying drawings, wherein:

FIG. 1*a* is a side section view of the clutch mechanism and switch device according to a prior electric screw driver;

FIG. 1*b* is an enlarged view of the two triangular cam protrusions of the upper and lower clutch member of FIG. 1*a;*

FIG. 1*c* is a side section view of the clutch mechanism and switch device of another prior electric screw driver which has an improvement on the clutch mechanism;

FIG. 1*d* is an enlarged view of the substantially triangular cam protrusion with two identical arcs with same curvature and bottom portion with width 'd' according to the improvement of FIG. 1*c;*

FIG. 10*a* is a top cross section view of the switch device of FIG. 9*a* and its plate assembly arrangement taken along the line A—A;

DETAILED DESCRIPTION OF THE PREFERRED EMBODIMENTS

The following is a detailed description of the best presently contemplated embodiments of the invention. This description is not to be taken in a limiting sense, but is made merely for the purpose of illustrating the general principles of the invention.

Figure 2A:
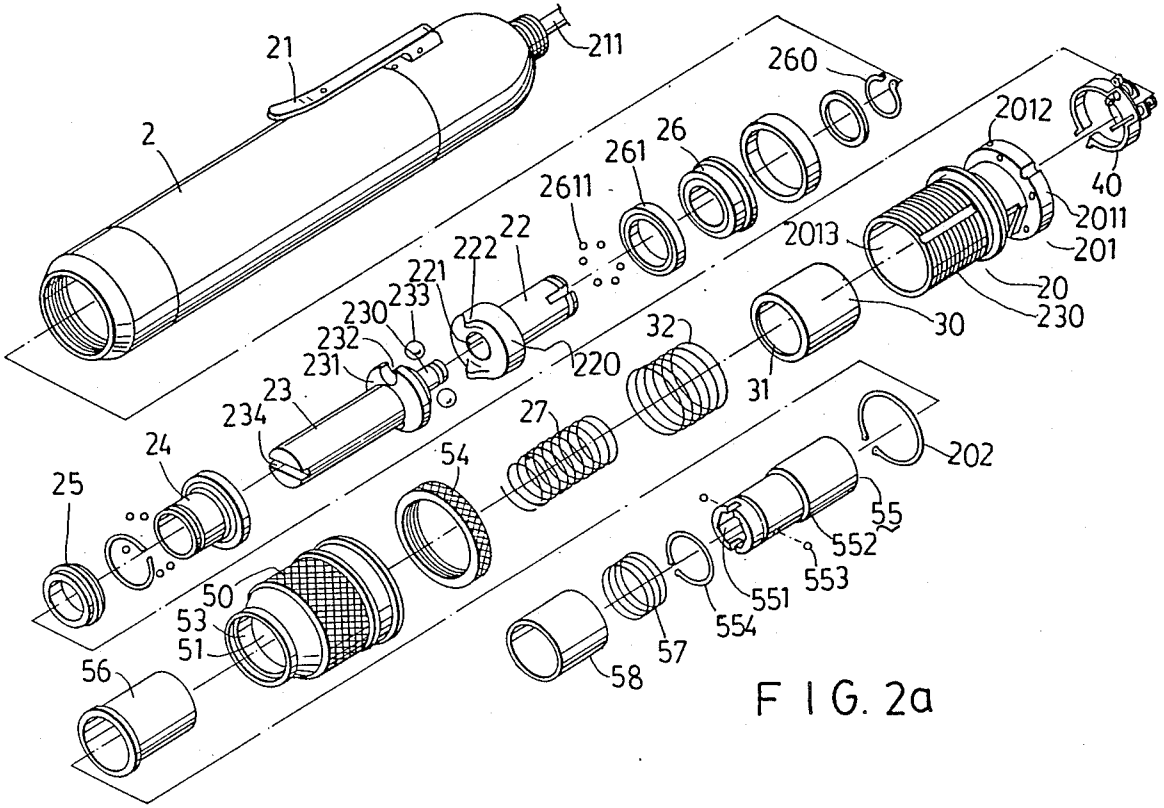
FIG. 2*a* is an exploded view of a first preferred embodiment of the invention with a novel clutch mechanism and switch device for automatically controlling the driving means of the screw driver.

Referring to FIG. 2*a* in conjunction with the FIGS. 2*b*, 2*c*, 2*d* and 7, the present invention includes a hollow cylindrical housing 2, a driving means 'M' (see FIG. 7), an extending power line 211 from a power source, a reducing gear mechanism 210 (see FIG. 2*b*) and an electric circuit for controlling the driving means are provided in the cylindrical housing 2. A handle switch 21, connecting with the electric circuit for turning on the driving means, is provided at an upper portion of the hollow cylindrical housing 2, and an improved automatic turn-off device comprises a clutch mechanism driven by the driving means through the gear mechanism is provided under the reducing mechanism 210.

The clutch mechanism includes a clutch housing 20 with a head portion 201, an inner annular flange portion 202 provided at its bottom opening and an outer threaded surface 203; an upper clutch member 22 with a base flange portion 220 and a bottom hollow portion 221, retained in the clutch housing 20; and a lower clutch member 23 with an upper extending portion 230 which is received in the bottom hollow portion 221 of the upper clutch member 22, wherein the head portion 201 of the clutch housing 20 further includes an upper flange portion 2011 with a screw hole 2012 for fixing the clutch housing 20 to the hollow cylindrical 2 through a screw. The upper clutch member 22 further has two substantially triangular-shaped cam protrusions 222, extending from the bottom surface of the base flange portion 220, which each have two different sides with different arcs 'B' and 'C' wherein the curvature of arcs 'B' is larger than the curvature of arcs 'C'. The lower clutch member 23 has an annular flange portion 231 provided between the lower clutch member 23 and its upper extending portion 230. An annular groove 235 is provided on the upper extending portion 230 of the lower clutch member 23 so that the lower clutch member 23 can be fixed to the upper clutch member 22 by a bolt 236 around the annular groove 235. Two holes 232 and two ball members 233 are provided on the annular flange portion 231 of the lower clutch member 231 and the ball members 233 can be received in the holes 232 once they are moved into the hole 232 by the cam protrusion 222 of the upper clutch member. A sleeve member 24 and a bearing ring 25 are movably sleeved and retained on the lower clutch member 23.

The head portion 201 of the clutch housing 20 has a hollow portion 2013 for receiving the upper clutch member 22. A bearing member 26 is provided at the upper end of the upper clutch member 22 and the upper clutch member 22 is retained firmly in the head portion 201 of the clutch housing 20 by a C-hook ring 260. A bearing ring 261 with a plurality of balls 2611 are provided on the base flange portion 220 of the upper clutch member 22.

A switch device 40 for short circuiting the driving means controlling electric circuit 'A' and turning off automatically the driving means 'M' is adapted to connect with the power source and is provided on the head portion 201 of the clutch housing 20. The switch device 40 includes a clamp ring 41 which can clamp around the head portion 201 of the clutch housing 20 for retaining the switch device 40 firmly on the head portion 201, and upper projecting plate 42 and a lower projecting plate 43 which are parallelly provided on the clamp ring 41. Two contacting plates 44, 45 which are connected with the electric circuit 'A' are provided between the two upper and lower projecting plate 42, 43, wherein the two contacting plates 44, 45 can be connected with each other through a movable pin 49 which is provided on the upper projecting plate 42. A movable rod member 47 with an upper bent portion 48 for pushing the movable pin 49 is vertically provided on the two upper and cower projecting plates 42, 43 and extends into the clutch housing 20.

A tubular supporting sleeve member 30 for supporting the movable rod member 47 of the switch device 40 is received in the clutch housing 20 and provided around the upper and lower clutch member 22, 23 so that the upper bent portion 48 of the movable rod member 47 is pushed upward slightly to disengage from the movable ring 49 so that the driving means 'M' can work if the user turn on the handle switch 21. The tubular supporting sleeve member 30 has an inwardly bent flange portion 31 (see FIG. 2*b*) at its bottom end for retaining the bearing ring 25 and the sleeve member 24 of the lower clutch member 23. A force-absorbing spring member 32 disposes on the inner annular flange 202 of the clutch housing 20 and sleeves on the sleeve member 24 of the lower clutch member 23 for supporting and pushing upward the tubular supporting sleeve member 30.

A cylindrical cover member 50 with a bottom opening 51 and an inner threaded surface 52 is threaded on the outer threaded surface 203 of the clutch housing 20 for covering the lower clutch member 23, wherein an inner flange portion 53 is provided at the bottom opening 51 of the cylindrical cover member 50. An inner threaded lock ring 54 is sleeved on the clutch housing 20 and disposed on the cylindrical cover member 50 for retaining the cylindrical member 50 more firmly.

Figure 2B:
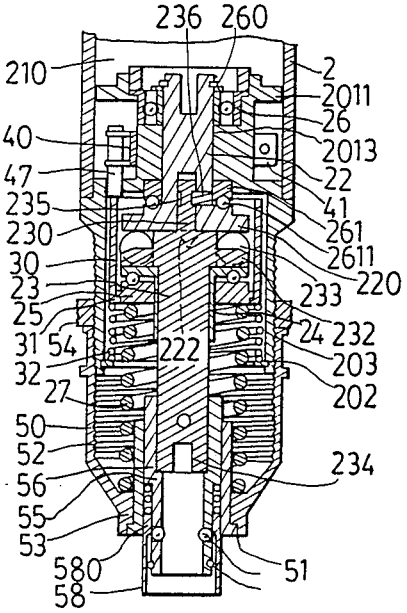
FIG. 2*b* is a side section view of the clutch mechanism and switch device arrangement used in FIG. 2*a;*
Figure 2C:
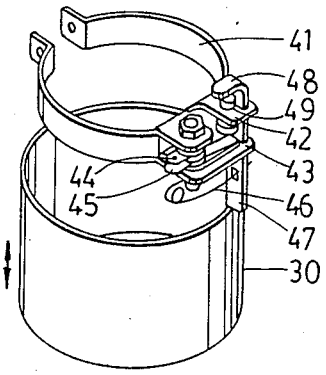
FIG. 2*c* is a perspective view of the switch device used in FIG. 2*a* and FIG. 2*b;*
Figure 2D:
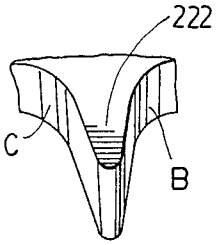
FIG. 2*d* is an enlarged view of the substantially triangular cam protrusion with two different arcs 'B', 'C' with different curvatures and a bottom portion with width narrower than the cam protrusion of FIG. 1*d* according to the improvement of FIG. 2*a* and FIG. 2*b;*
Figure 2E:
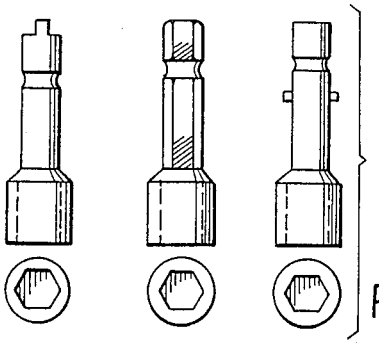
FIG. 2*e* shows a plurality of box spanners which can be used with the present invention.
Figure 2F:
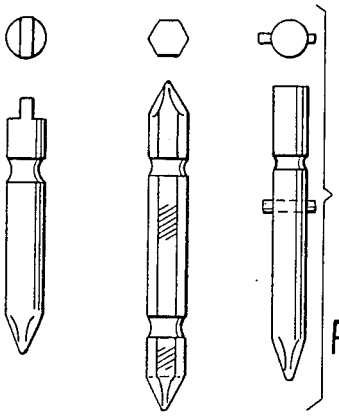
FIG. 2*f* shows a plurality of screw drivers which can be used with the present invention.

Referring to FIG. 2*b*, a torsion spring 27 for supporting the bearing ring 25 and the sleeve member 24 of the lower clutch member 23 is disposed on the inner flange portion 53 of the cylindrical cover member, retained between the clutch housing 20 and the cylindrical cover member 50 and sleeved on the lower clutch member 23. A hollow socket base member 56 is provided at the bottom opening 51 of the cylindrical cover member 50. A socket member 55 having an inner hollow portion of polygonal cross-section 551, adapted to receive different kinds of screw drivers (see FIG. 2*e*) or box spanners (see FIG. 2*e*) is inserted into the cylindrical cover member 50 through the hollow socket base member 56 and fixed to the lower clutch member 23. The socket member 55 has a shoulder portion 552 for blocking a spring member 57, and two retaining ball member 553 and retaining ring 554 are provided at the bottom end portion of the socket member 55. A retaining sleeve 58 with an inner flange portion 580 for retaining the screw driver or spanner firmly in the socket member 55 is received in the hollow socket base member 56 and sleeved on the socket member 55 so that the inner flange portion 580 of the retaining sleeve 58 can press the ball 553 as the spring member 57 biasing the retaining sleeve 58. The bottom slot 234 of the lower clutch member 23 is adapted to receive an upper projection of the screw driver.

The electric circuit 'A' further has a controlling switch 'S' for driving the driving means 'M' to rotate in clockwise or counter clockwise direction. When in use, the electric screw driver can tighten (the driving means 'M' rotates in clockwise direction) or unfasten (the driving means 'M' rotates in counter clockwise direction) a screw or a nut on a workpiece if the electric screw driver is switched on through the handle switch 21, as the driving means 'M' drives the clutch mechanism. If the screw or nut is tightened tightly, the lower clutch member 23 is stopped rotating due to the opposing force of the screw, but the upper clutch member 22 continues to rotate because the handle switch is still turned on so that the substantially trangular protrusion 222 of the upper clutch member 22 move the balls 233 into the holes 232 and the balls 233 pass through the holes 232 and press down the sleeve member 24. The tubular supporting sleeve member 30 is pushed down by the bearing ring 25 and disengages from the movable rod member 47 of the switch device 40. The switch device 40 further includes a leaf spring 46 which can push down the rod member 47 when the tubular supporting sleeve member 30 release from the rod member 47. Then the bent portion 48 of the rod member 47 pushes the pin 49 to contact the two contacting plates 44, 45 so that the driving means 'M' is short circuited and stopped from working even though the handle switch 21 is turned on. (see FIG. 7). By the above-mentioned arrangement, the electric screw driver is automatically controlled to stop once the screw driver has already tightened the screw or nut tightly.

The user can release the handle switch 21 when the electric screw driver stop automatically through the switch device 40. Then, the torsion spring 27 can move the tubular supporting sleeve member 30 upward (i.e., to its initial position) due to torsion force, and the rod member 47 is pushed upward and disengaged from the pin member 49 so that the two contacting plates 44, 45 are separated from each other, so that the electric screw driver is ready for the next operation. During this operation, the spring 32 function as an absorber to absorb the rebounding force of the torsion spring 27 to the switch device 40 for preventing the switch device 40 from being damaged from the bounce of the tubular supporting sleeve member 30.

When the electric screwdriver is used for unfastening a screw or nut, the initial force that the driving means 'M' has to overcome is greater than the tightening operation. As the curvature of arc 'B' is greater than that of arc 'C', (see FIG. 2*d*), the lower clutch member 23 is easily driven by the upper clutch member 22 through the greater curvature of arc 'B'. The total length of the electric screw driver of this invention is 2.5–5 cm shorter than the prior design as the socket member 55 is arranged in the cylindrical cover member 50, so that the user can use the screw driver more conveniently and effectively.

Figure 3A:
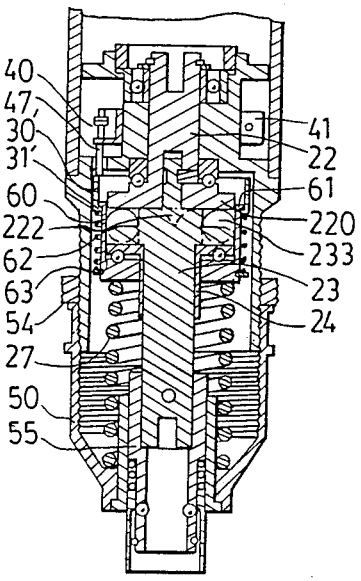
FIG. 3*a* is a side section view of the clutch mechanism and switch device arrangement according to a second preferred embodiment of the present invention.
Figure 3B:
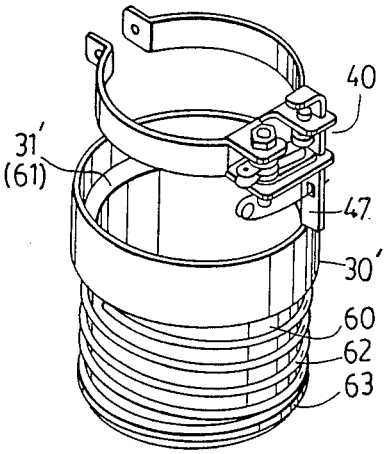
FIG. 3*b* is a perspective view of the switch device used in FIG. 3*a;*

FIG. 3*a* is a side section view of a second preferred embodiment according to the present invention and FIG. 3*b* shows the improvement of the switch device supporting means and force absorbing spring. The switch device supporting means includes a supporting ring 30' with a bottom inner inwardly bent flange portion 31' and an annular bowl 60 with an opening at its base and an outwardly bent flange portion 61 at its upper end, wherein the bottom inwardly bent flange portion 31' of the supporting ring 30' can hook on the outwardly bent flange portion 61 of the annular bowl 60, and the bearing ring 25 and the sleeve member 24 sit on the inner surface of the base of the annular supporting bowl 60. The lower clutch member 23 and the sleeve member 24 pass through the bottom opening of the supporting bowl member 60. A bottom annular flange portion 63 is provided at the base of the supporting bowl 60 and a force absorbing spring 62 disposes on the bottom annular flange portion 63 of the supporting bowl member 60 and sleeves thereon to support the supporting ring 30'. The supporting bowl 60 is supported by the torsion spring 27 so that the supporting ring 30' can disengage from the rod member 47 of the switch device when the two balls 233 are pushed into the holes 232 of the sleeve member 24 by the substantial triangular cam protrusions 222, to push down the sleeve member 24 and supporting bowl 60 so that the switch device 40 function as described in the first preferred embodiment.

Figure 4:
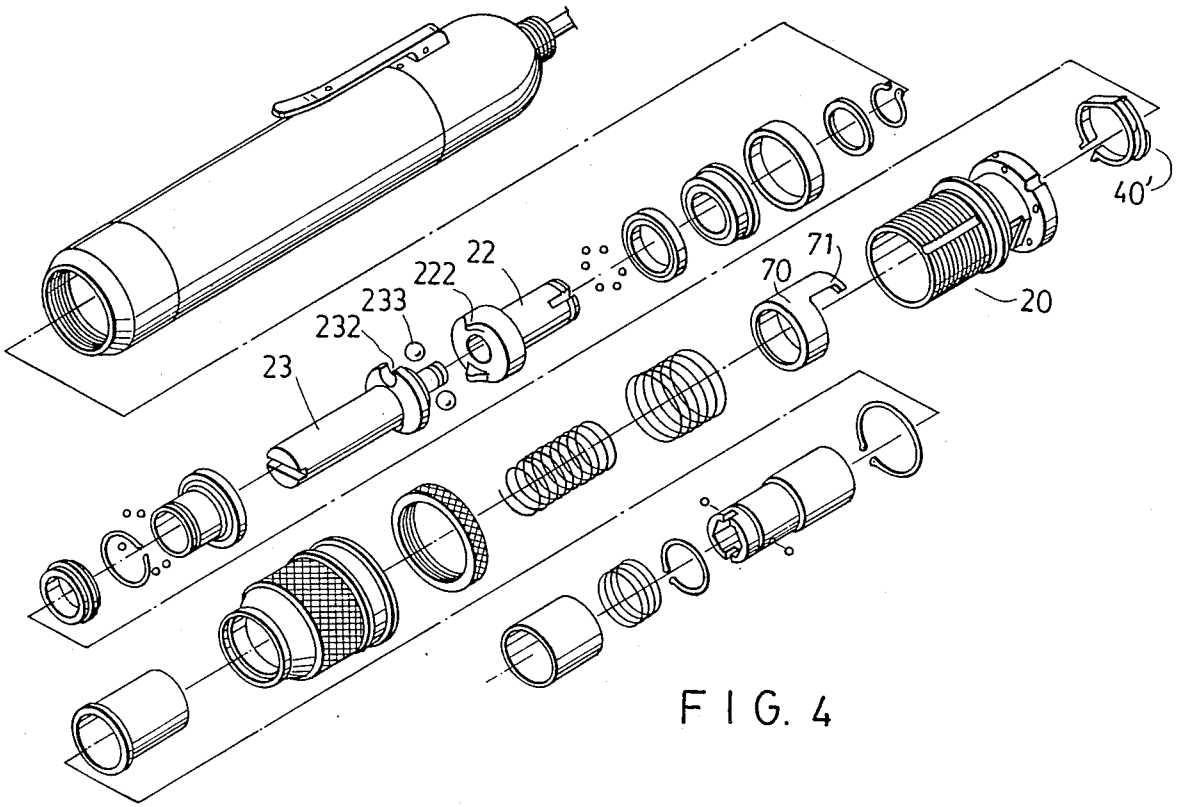
FIG. 4 is an exploded view of a third preferred embodiment of the present invention showing an improvement on its clutch mechanism and switch device.
Figure 5A:
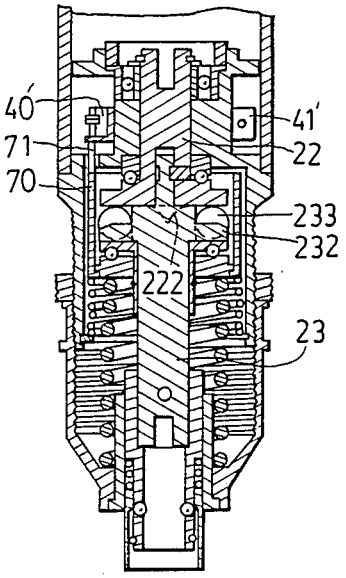
FIG. 5*a* is a side section view of the clutch mechanism and switch device arrangement used in FIG. 4.
Figure 5B:
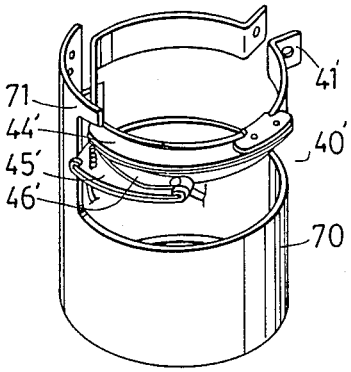
FIG. 5*b* is a perspective view of the switch device used in FIG. 4 and FIG. 5*a;*

FIG. 4 shows an exploded view of a third preferred embodiment of the present invention. Referring to FIG. 4 in conjunction with FIGS. 5*a*–5*b*, there is an improvement in a switch device 40' and a hollow sleeve member 70 with an upwardly extending hook member 71 instead of the switch device 40 and the tubular supporting sleeve member 30 of the first preferred embodiment. The switch device 40' includes a clamp ring 41' for clamping the switch device 40' around the head portion of the clutch housing 20 and two parallel plates 44', 45', each of which includes a contacting point which is connected with the electric circuit 'A'. A spring leaf member 46' is provided between the two parallel plates 44', 45' and is arranged so that the two contacting point of the parallel plates 44', 45' are normally disengaged. The upward extending hook member 71 of the sleeve member 70 hooks on the upper parallel plate 44', wherein the hook member 71 can pull down the upper plate 44' to connect the two contacting points of the two parallel plates 44' and 45' together for short circuiting the driving means 'M'. The electric screw driver functions as does the first preferred embodiment.

Figure 6A:
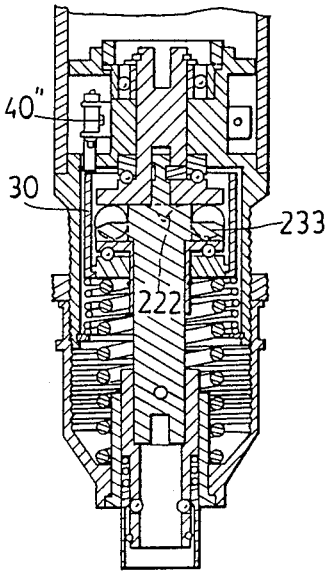
FIG. 6*a* is a side section view of the clutch mechanism and switch device arrangement according to a fourth preferred embodiment.
Figure 6B:
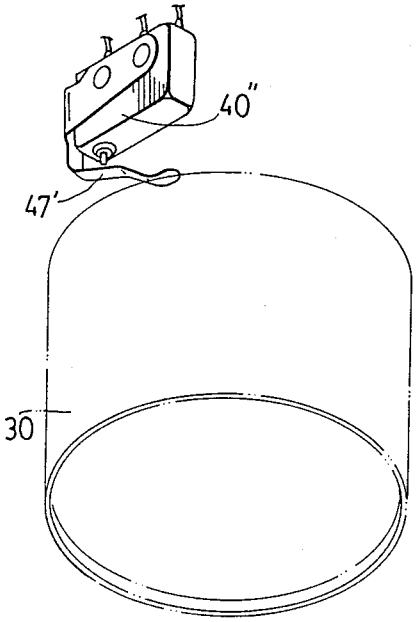
FIG. 6*b* is a perspective view of a microswitch used in FIG. 6*a;*
Figure 7:
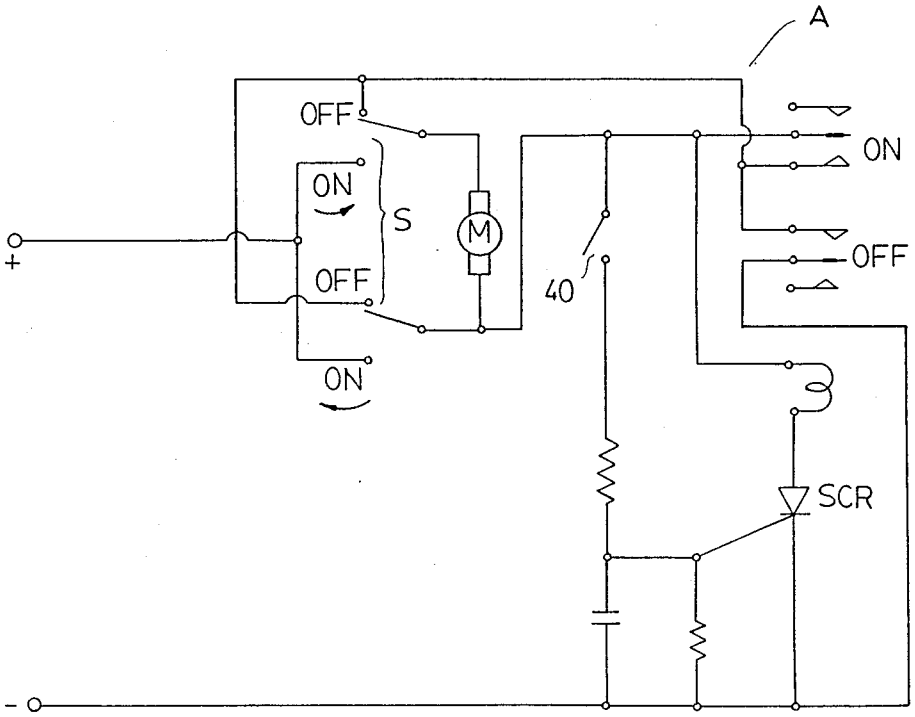
FIG. 7 is an electric circuit used in all above-mentioned preferred embodiments.

FIG. 6*a* shows a side section view of a fourth preferred embodiment of the present invention and FIG. 6*b* shows a novel switch device which is used instead of the switch device 40 of the first preferred embodiment. The switch device use in FIGS. 6*a*–6*b* is a microswitch 40". An actuating pushing plate 47' provided under the microswitch 40", is pushed upwardly by the tubular supporting sleeve 30 to press the microswitch 40", whereby the microswitch can short circuit the driving means 'M' when the pushing plate 47' is released from the microswitch 40" as the tubular supporting sleeve member 30 is moved down by the cam protrusions 222 and the balls 233. The electric screw driver functions as does the first preferred embodiment.

Figure 8:
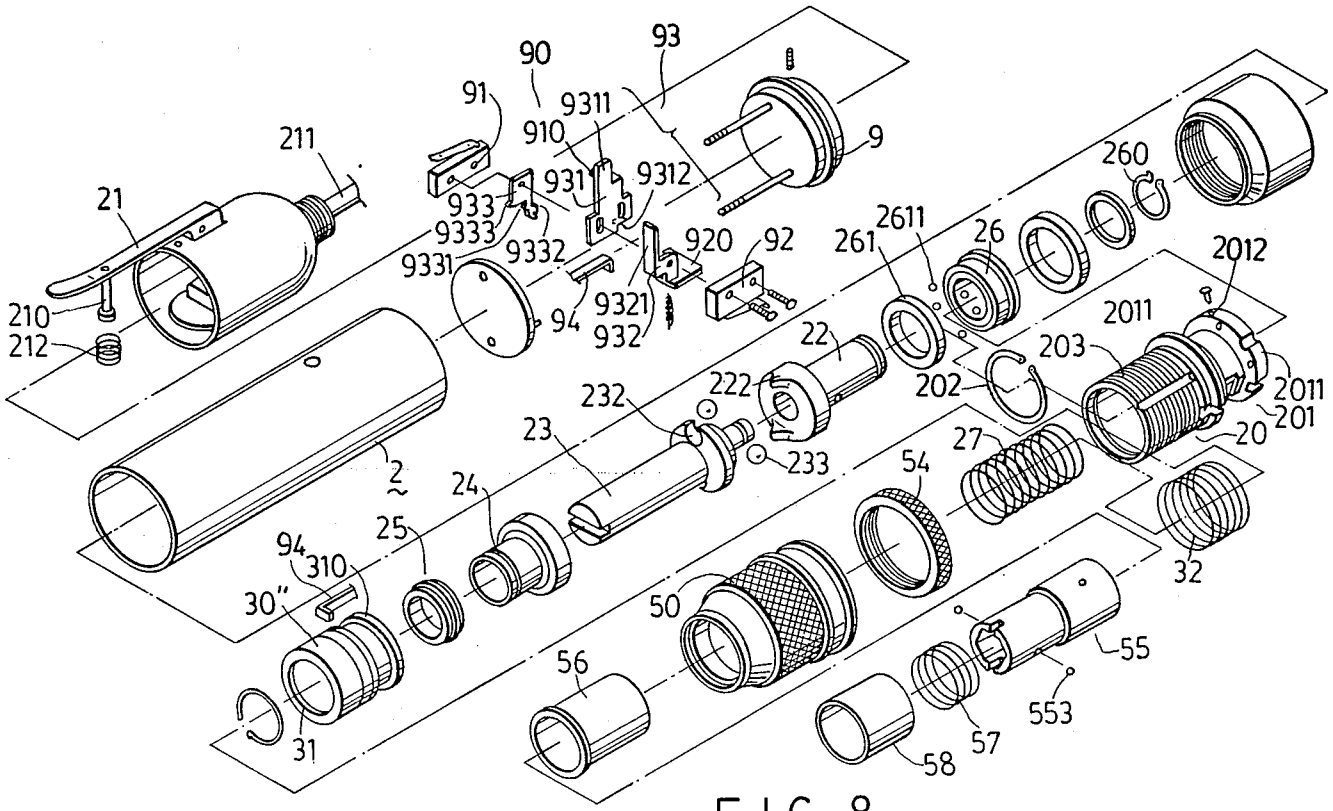
FIG. 8 is an exploded view of a fifth preferred embodiment showing a novel switch device arrangement for controlling the driving means of the electric screw driver.
Figure 9A:
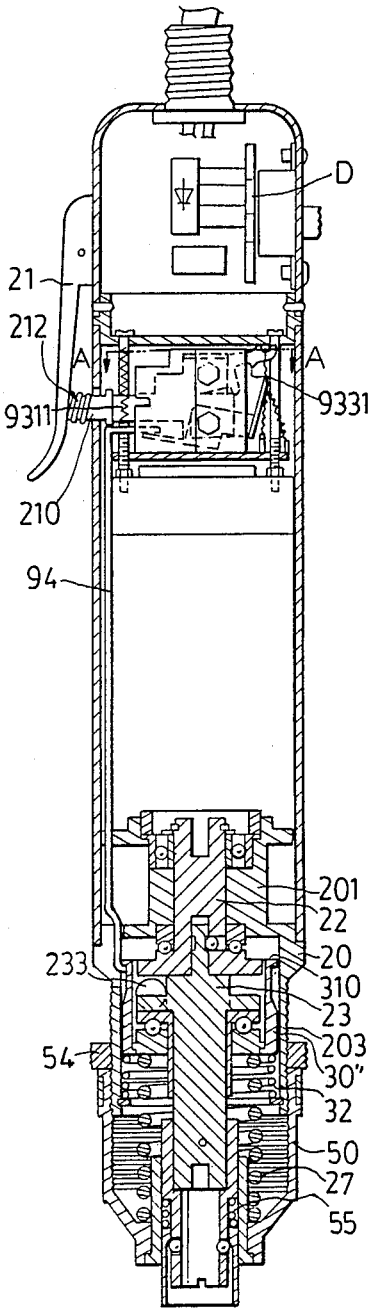
FIG. 9*a* is a side section view of FIG. 8 showing the clutch mechanism and plate assembly of the switch device set in their initial position.
Figure 9B:
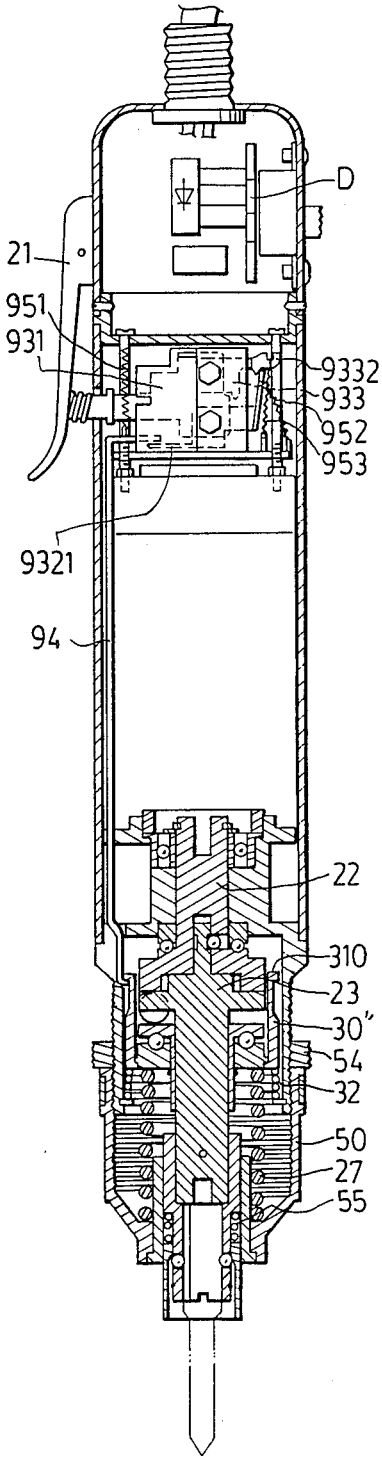
FIG. 9*b* is a side section view of FIG. 8 showing the clutch members being pushed down by the ball member, and the fulcrum plate member of the switch device being moved by the rod member when the lower clutch member is stopped rotating as it has already tightened a screw or nut tightly, and the driving means being stopped automatically through the switch device.
Figure 10B:
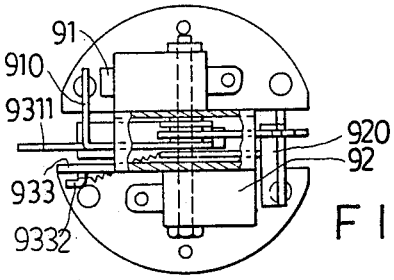
FIG. 10*b* is an enlarged and schematic view of the plate assembly of the switch device in FIG. 9*a* when the driving means of the electric screw driver is turned off automatically even if the user has switched on the handle switch.
Figure 10B:
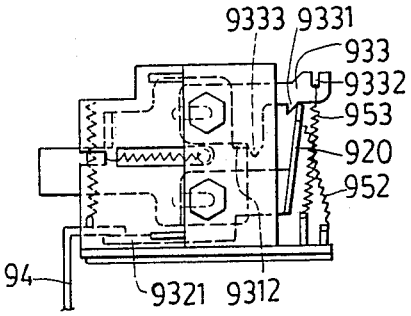
Figure 10C:
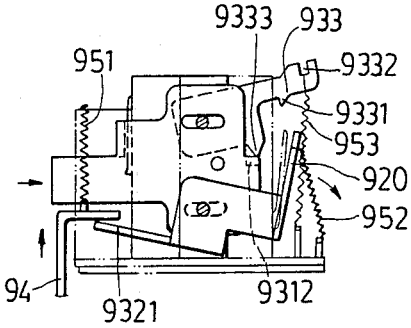
FIG. 10*c* is a schematic view of the plate assembly of the switch device in FIG. 9*a* showing the fulcrum plate and the remaining plates returned to their initial position because of the torsion spring of the clutch members, and the retaining spring member of the rod member which hooks on the fulcrum plate member.

The electric screw driver can be arranged in a novel arrangement as shown in FIG. 8, FIG. 9*a* and FIG. 9*b*. A chamber 9 for retaining a novel switch device 90 is provided in the upper portion of the hollow cylindrical housing 2 adjacent to the handle switch 21. The switch device of all the above mentioned four preferred embodiments which are provided around the head portion 201 of the clutch housing 20 are substituted for by the novel switch device 90 of the chamber 9; and the electric circuit 'A' is substituted by a new electric circuit 'D' so that the clutch mechanism and clutch housing 20 are simpler and easier to assemble.

Referring to the above mentioned three Figs. in conjunction with the FIGS. 10*a*, 10*b*, 10*c*, 13*a*, 13*b* and 13*c*, the switch device 90 includes a first switch 91 controlled by the handle switch 21 for controlling the input power and a second switch 92 for controlling the operation of the driving means 'M'; a movable plate assembly 93 with a plurality of spring members, wherein the movable plate assembly 93 is in an arrangement for switching on and off the first and second switch 91, 92. The movable plate assembly 93 of the switch device 90 includes a first plate member 931 with an extending portion 9311 extending out of the hollow cylindrical housing 2. A push rod 210 connects with the handle switch 21, and biasing spring 212 is sleeved on the extending portion 9311. A first switch contacting portion 910 of the first plate member 931 is provided adjacent to the first switch 91. A second plate member 932 is arranged as a fulcrum and has a base extending portion 9321 for engaging with an elongated rod member 94 and a second switch contacting portion 920 for controlling the second switch 92. The movable plate assembly 93 further includes a third plate member 933 with a safety retaining protrusion 9331 for preventing the second contacting portion 920 of the second plate member 932 from contacting the second switch 92 when the driving means 'M' is in normal operation, as the second switch is arranged in normally closed condition for the electric circuit 'D'.(see FIGS. 13*a*, 13*b* and 13*c*).

The bottom end of the elongated rod member 94 is engaged with the upper outwardly bent flange portion 310 of the tubular sleeve 30". The plurality of spring members includes a first pulling spring 951 to retain the rod member 94. A second pulling spring 952 connects with the second contacting portion 920 of the second plate member 932 and normally pulls the second contacting portion 920 away from the second switch 92. The third plate member 933 further includes a hook portion 9332 engaged with a third pulling spring 952 so that the third plate member 933 is pulled downwardly. The first spring member 931 further includes a supporting projecting portion 9312 and the third plate member 933 has a base protrusion 9333 which can rest on the supporting projecting portion 9312.

When in use, (referring to FIGS. 10*a*, 10*b*, 10*c* in conjunction with FIGS. 13*a*, 31*b*, 13*c*), if the user grips the handle switch 21, the extending portion 9311 of the first plate member 931 is pushed by the pushing rod 210 and the first switch contacting portion 910 contacts the first switch to switch on the first switch 91. At this time, the driving means 'M' starts to work, as the second switch 92 is arranged in normally closed condition (i.e., the switch 92 is in closed condition if it is not actuated) so that the screw driver can tighten a screw or a nut on a workpiece. If the screw is tightened tightly, the substantial triangular cam protrusion 222 of the upper clutch member 22 move the balls 233 into the holes 232 of the lower clutch member 23, as the lower clutch member has stopped rotating due to the tightness of the screw. Then, the balls 233 pass through the holes 232 and press down the sleeve member 24 so that the tubular sleeve 30" is pressed down by the bearing ring 25 and the base extending portion 9321 is pulled down by the rod member 94. The supporting projection 9312 of the first plate member 931 can push the base protrusion 9333 of the third plate member 933 so that the third plate member 933 is pushed up, and the retaining protrusion 9331 release the second switch contacting portion 920 of the second plate 932 to contact with the second switch 92 so that the switch 92 is opened (breaking the electric circuit). Then, the driving means 'M' stop at this time even though the handle switch 21 is gripped and the first switch 91 is turned on.

After the driving means 'M' stops working, the user can release the handle switch so that the first plate member 931 can move back to its initial position, and the supporting projection 9312 pushes the base protrusion 9333 again so that the retaining protrusion 9331 releases the second switch contracting portion 920 to move away from the second switch 92 due to the pulling spring 952, and the switch device 90 is ready for next operation. (see FIGS. 10*b* and 10*c*)

Figure 13A:
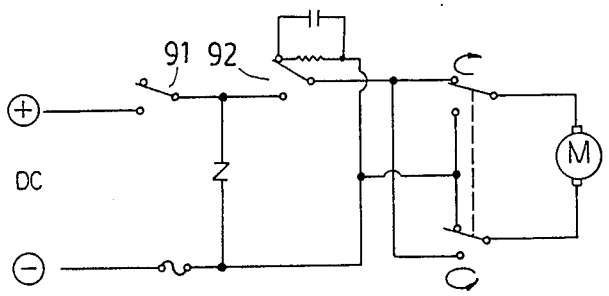
FIG. 13*a* is an electric circuit with D.C. power source used in the fifth and sixth preferred embodiment and showing how the two switch member and the movable plate assembly control the driving means.
Figure 13B:
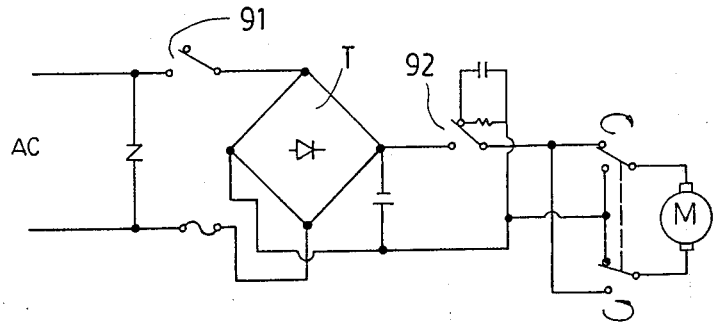
FIG. 13*b* shows another electric circuit with an A.C. power source which can be used instead of the electric circuit with D.C power source of the invention.
Figure 13C:
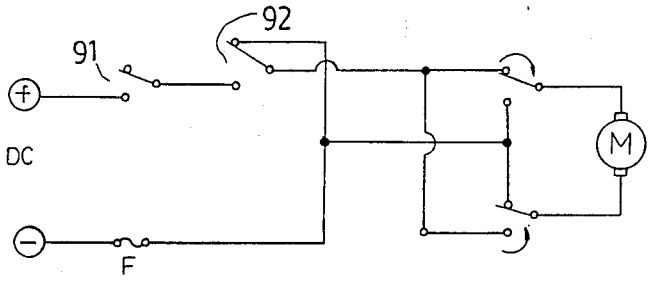
FIG. 13*c* shows a further electric circuit arrangement used for the fifth and sixth preferred embodiments.

FIG. 13*b* shows an electric circuit for the electric screw driver of FIG. 8 with a bridge rectifying circuit 'T' for an ac power source.

Figure 11:
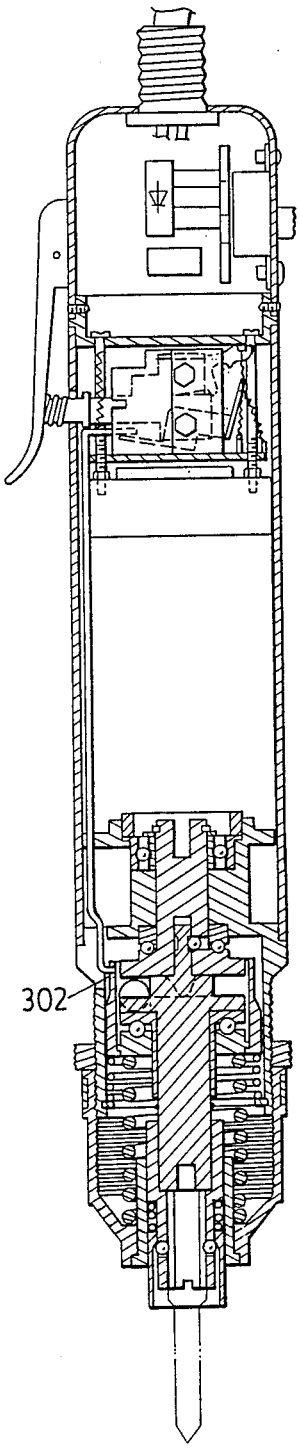
FIG. 11 is a side section view of a sixth preferred embodiment of the present invention showing the elongated rod member of the switch device directly hooked with the tubular sleeve of the clutch member through a hole.

FIG. 11 shows a sixth preferred embodiment of the present invention in which the elongated rod member 94 of the switch device 90 is directly hooked with the tubular sleeve member 30″ of the clutch mechanism through a hole 302.

Figure 12:
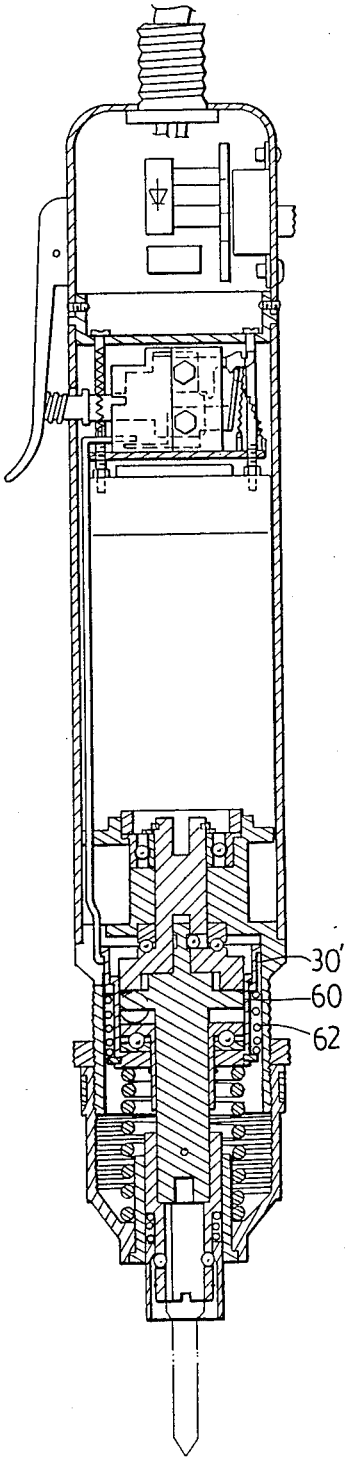
FIG. 12 is a side section view of a seventh preferred embodiment of the present invention showing a novel arrangement on the tubular sleeve for reducing the rebounding of the torsion spring to the plate assembly of the switch through the elongated rod member.

FIG. 12 shows a seventh preferred embodiment of the present invention in which the arrangement of the tubular supporting ring 30′ and the supporting bowl member 60 are the same with the second preferred embodiment which shows in FIG. 3*a*. But the tubular supporting ring 30′ in FIG. 12 further includes an upper outwardly bent portion for engaging with the rod member 94.

While the invention has been described with what are presently considered to be the most practical and preferred embodiments, it is to be understood that the invention is not to be limited to the disclosed embodiments, but on the contrary, is intended to cover various modifications and equivalent arrangements included within the spirit and scope of the appended claims, which scope is to be accorded the broadest interpretation so as to encompass all such modifications and equivalent structures.

What I claim is:

1. An electric screw driver having a hollow cylindrical housing, a driving means, an electric circuit with power source for controlling said driving means and a reducing gear mechanism which are provided in said cylindrical housing, a handle switch for turning on said driving means provided at an upper portion of said hollow cylindrical housing, and an improved automatic turn-off device comprising:

a clutch mechanism driven by said driving means including a clutch housing with a head portion, an inner annular flange portion provided at a bottom opening thereof and an outer threaded surface, an upper clutch member with a base flange portion and a bottom hollow portion, firmly received in said clutch housing and a lower clutch member with an upper extending portion which is received in said bottom hollow portion of said upper clutch member; wherein: said head portion of said clutch housing further includes an upper flange portion with a screw hole for fixing said clutch housing to said hollow cylindrical housing through a screw, and said upper clutch member further has a substantially triangular-shaped cam protrusion extending from the bottom surface of said base flange portion which has two arcs with different curvatures, and said lower clutch member has an annular flange portion provided between said lower clutch member and its upper extending portion, a hole and a ball member are provided on said annular flange portion of said lower clutch member and said ball can be received in said hole once it is moved into said hole by said cam protrusion, a sleeve member movably sleeves on said lower clutch and a bearing ring is movably sleeved and retained on said sleeve member;

a switch device for short circuiting said driving means to turn off automatically said driving means, adapted to connect with said electric circuit, which is provided on said head portion of said clutch housing;

means for supporting said switch device received in said clutch housing and provided around said upper and lower clutch member for controlling said switch device to short circuit said driving means;

a cylindrical cover member with a bottom opening and an inner threaded surface threaded on said outer threaded surface of said clutch housing for covering said lower clutch member, wherein an inner flange portion is provided at said bottom opening of said cylindrical cover;

a torsion spring member retained between said clutch housing and said cylindrical cover member and sleeved on said lower clutch member, and disposed on said inner flange portion of said cylindrical cover member for supporting and biasing said bearing ring and said sleeve member of said lower clutch member; and a socket member adapted to receive different kinds of screwdrivers or box spanners, and inserted into said cylindrical cover member through said bottom opening of said cylindrical cover member and fixed to said lower clutch member;

whereby, said electric screwdriver can tighten or unfasten a screw or a nut on a workpiece if said electric screwdriver is switched on through said handle switch as said driving means drives said clutch mechanism, and said substantially trangular protrusion of said upper clutch member may move said ball into said hole of said lower clutch member when said clutch member is stopped rotating if said screw or nut is tightened tightly, and said ball can press down said sleeve member through said hole so that said switch device supporting means is pressed down by said bearing ring and disengaged from said switch device, whereby said driving means is short circuited and stopped from working even though said handle switch is turned on.

2. An improved electric screw driver as claimed in claim 1, in which said switch device includes two contacting plates and a movable rod member for connecting said two contacting plates, which vertically extends into said clutch housing, wherein said switch device is in an arrangement that said two contacting plates are normally disconnected when said driving means is turned on through said handle switch, and said driving means is stopped operating, even if said handle switch is turned on, if said rod member engages said two contacting plates to short circuit said driving means.

3. An improved electric screw driver as claimed in claim 1, wherein said switch device supporting means is a tubular sleeve which has an inwardly bent flange portion at a bottom end thereof for retaining said bearing ring and said sleeve member of said lower clutch member.

4. An improved electric screw driver as claimed in claim 3, wherein said tubular supporting sleeve member further includes a force-absorbing spring which sleeves on said sleeve member of said lower clutch member, and which is provided on said inner annular flange of said clutch housing for supporting and biassing said tubular supporting sleeve member.

5. An improved electric screw driver as claimed in claim 2, in which said switch device supporting means includes a supporting ring member with a bottom inner inwardly bent flange portion and an annular bowl with an opening at its base thereof, wherein said bearing ring and said upper annular flange portion of said lower clutch member sit on the inner surface of said base of said annular supporting bowl member and said lower clutch member and sleeve member pass through said opening of said supporting bowl member; said supporting bowl member including an upper outwardly bent flange portion provided at an upper end thereof which is engaged with said inwardly bent flange portion of said supporting ring member.

6. An improved electric screw driver as claimed in claim 5, wherein said supporting bowl member further has a bottom annular flange portion provided at the base of said supporting bowl member and a second force-absorbing spring member disposes on said bottom annular flange portion of said supporting bowl and sleeves on said supporting bowl member to support said supporting ring member, and said supporting bowl member is supported by said first spring member so that said supporting ring member can disengage from said rod member of said switch device when said ball is pushed into said hole of said sleeve member by said substantially triangular cam protrusions, and the balls to push down said sleeve member and bowl member and then to short circuit and to stop said driving means.

7. An improved electric screw driver as claimed in claim 1, in which said switch device includes two parallel plates, each of which includes contacting point which is connected with said electric circuit, and a spring leaf member provided between said two parallel plates for normally spacing apart said two parallel plates and wherein said switch device supporting means is a hollow sleeve member with an upwardly extending hook member which can hook on said upper plate of said two parallel plates, wherein said hook member can pull down said upper plate of said two parallel plates to connect said two contacting points together for short circuiting said driving means when said ball member is pushed into said hole of said lower clutch member by said cam protrusions when said lower clutch member stops rotating as said screw or nut of a workpiece has already been tightened by said screw driver.

8. An improved electric screw driver as claimed in claim 1, in which said switch device is a microswitch and an actuating pushing plate is provided under said microswitch, which is pushed upwardly by said switch device supporting means to press said microswitch, wherein said microswitch can short circuit said driving means when said pushing plate is released from said microswitch, when said switch device supporting means is moved downwardly.

9. An improved electric screw driver including a hollow cylindrical housing, a driving means, an electric circuit connecting with a power source and a reducing gear mechanism which are provided in said cylindrical housing, and a handle switch at the upper portion of said housing comprising:

a chamber provided in the hollow cylindrical housing adjacent to said handle switch;

a clutch mechanism driven by said driving means including a clutch housing with a head portion, an inner annular flange portion provided at a bottom opening thereof and an outer threaded surface, an upper clutch member with a base flange portion and a bottom hollow portion, slidably received in said clutch housing, and a lower clutch member with an upper extending portion which is received in said bottom hollow portion of said upper clutch member; wherein: said head portion of said clutch housing further includes an upper flange portion with a screw hole for fixing said clutch housing to said hollow cylindrical housing through a screw, and said upper clutch member further has a substantially triangular-shaped cam protrusion extending from the bottom surface of said base flange portion which has two arcs with different curvatures, and said lower clutch member has an annular flange portion provided between said lower clutch member and its upper extending portion, a hole and a ball member are provided on said annular flange portion of said lower clutch member and said ball can be received in said hole once it is moved into said hole, a sleeve member movably sleeves on said lower clutch and a bearing ring is sleeved and retained on said sleeve member;

a switch device provided in said chamber including a first switch controlled by said handle switch for controlling the input power and a second switch for controlling the operation of said driving means, and a movable plate assembly with a plurality of spring members, wherein said movable plate assembly is in an arrangement for switching on and off said first and second switch;

a tubular sleeve with an inwardly bent flange portion at a bottom end thereof for retaining said bearing ring and said sleeve member of said lower clutch member movably provided around the connection of said lower and upper clutch member in said clutch housing, and an outwardly bent flange portion provided at the upper portion of said tubular sleeve;

an elongated rod member, one end being connected with said movable plate assembly and the other end engaged with said upper outwardly bent flange portion of said tubular sleeve;

a cylindrical cover member with a bottom opening and an inner threaded surface threaded on said outer threaded surface of said clutch housing for covering said lower clutch member, wherein an inner flange portion is provided at said bottom opening of said cylindrical cover;

a torsion spring member retained between said clutch housing and said cylindrical cover member and sleeved on said lower clutch member, and disposed on said inner flange portion of said cylindrical cover member for supporting and biassing said bearing ring and said sleeve member of said lower clutch member; and a socket member adapted to receive different kinds of screwdrivers or box spanners, and inserted into said cylindrical cover member through said bottom opening of said cylindrical cover member and fixed to said lower clutch member;

whereby, said electric screw driver can tighten or unfasten a screw or nut on a workpiece if said electric screw driver is switched on through said first switch of said switch device by pressing said handle switch as said driving means drives said clutch mechanism, and said substantially triangular protrusion of said upper clutch member may move said ball into said hole of said lower clutch member when said clutch member is stopped rotating if said screw or nut is tightened tightly, and said ball can press down said sleeve member through said hole so that said tubular sleeve is pressed down by said bearing ring and sleeve member of said lower clutch member, wherein said second switch of said switch device is controlled to stop said driving means through said elongated rod member by actuating said second switch at this time even if said handle switch is turned on.

10. An improved electric screw driver as claimed in claim 9, wherein said movable plate assembly of said switch device includes a first plate member with an extending portion extending out of said hollow cylindrical housing and connecting with said handle switch and a first switch contacting portion provided adjacent to said first switch, a second plate member being arranged as a fulcrum having a base extending portion for engaging with said elongated rod member, a second switch, contacting portion for controlling said second switch and a third plate member with a safety retaining protrusion for preventing said second contacting portion of said second plate member from contacting said second switch when said driving means is in normal operation as said second switch is arranged in normally closed condition for the electric circuit of said driving means.

11. An improved electric screw driver as claimed in claim 9, wherein said plurality of spring members includes a first pulling spring to retain said rod member and a second pulling spring connected with said second contacting portion of said second plate member which pulls said second contacting portion away from said second switch.

12. An improved electric screw driver as claimed in claim 9, wherein said tubular sleeve member further includes a force-absorbing spring which sleeves on said sleeve member of said clutch mechanism and said lower clutch member, and which is provided on said inner annular flange of said clutch housing for supporting said tubular sleeve member.

13. An improved electric screw driver as claimed in claim 9, in which said tubular sleeve member further includes an annular bowl with an opening at its bottom end, wherein said bearing ring and said upper annular flange portion of said lower clutch member sit on the inner surface of the base of said annular bowl and said lower clutch member and sleeve member pass through said opening of said bowl member; said bowl member including an upper outwardly bent flange portion provided at an upper end of said bowl member which is engaged with said inwardly bent flange portion of said tubular sleeve.

14. An improved electric screw driver as claimed in claim 13, wherein said bowl member further has a bottom annular flange portion provided at said base of said bowl member and a second force-absorbing spring member disposes on said bottom annular flange portion of said bowl member and sleeves on said bowl member to support said tubular sleeve member, and said bowl member is supported by said torsion spring member so that said tubular sleeve member can pull down said rod member when said ball is pushed into said hole of said sleeve member by said substantially triangular cam protrusion to push down said sleeve member and bowl member so that said driving means is stopped by said movable plate assembly through the downward movement of said rod member even if said driving means is switched on by said handle switch.

* * * * *